US005311959A

United States Patent [19]

Adams

[11] Patent Number: 5,311,959

[45] Date of Patent: May 17, 1994

[54] MINE TOOL ROOF BIT INSERT

[75] Inventor: Wayne F. Adams, Bristol, Va.

[73] Assignee: GTE Valenite Corporation, Troy, Mich.

[21] Appl. No.: 868,066

[22] Filed: Apr. 13, 1992

[51] Int. Cl.[5] ..... E21B 10/46

[52] U.S. Cl. ..... 175/420.1; 175/427

[58] Field of Search ..... 175/420.1, 427, 420.2

[56] References Cited

U.S. PATENT DOCUMENTS 3,807,515 4/1974 Evans ..... 175/420.1
4,342,368 8/1982 Denman ..... 175/420.1
4,356,873 11/1982 Dziak ..... 175/420.1
4,688,652 8/1987 Crist ..... 175/420.1
4,787,464 11/1988 Ojanen ..... 175/420.1 X

*Primary Examiner*—Terry Lee Melius
*Attorney, Agent, or Firm*—Bill C. Panagos

[57] ABSTRACT

A mine tool roof bit insert has two flat parallel sides extending in the long dimension of the insert and has two uppermost slanted surfaces extending between the two flat parallel sides. There is a trough at the top of the insert, which is between the two uppermost slanted surfaces and which is substantially orthogonal to the two flat parallel sides.

5 Claims, 1 Drawing Sheet

MINE TOOL ROOF BIT INSERT

This invention concerns mine tool roof bit inserts. Examples thereof are shown in U.S. Pat. Nos. 4,787,464; 4,688,652; 4,356,873 and 3,807,515. The inserts shown therein all have an apex where the two uppermost surfaces of the insert meet. The line where said two uppermost surfaces meet is generally at an angle with respect to the long dimension of the insert and aids in centering the insert during drilling.

In this invention there is no such line where the two uppermost surfaces meet. Instead, there is a trough, substantially orthogonal to the long dimension of the insert, where the two uppermost surfaces of the insert meet.

Figure 1:
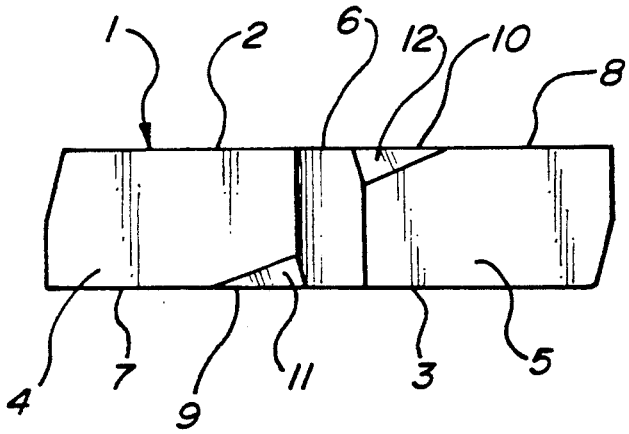
Figure 2:
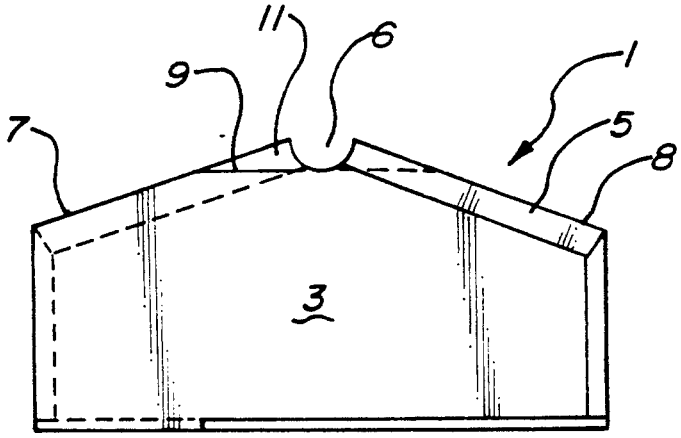
Figure 3:
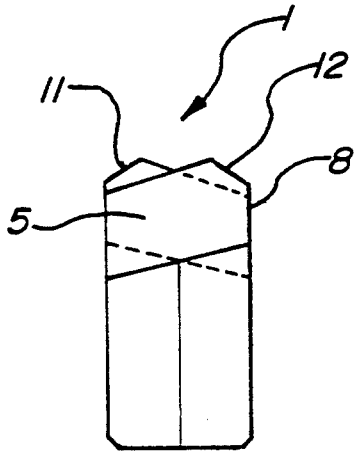
Figure 4:
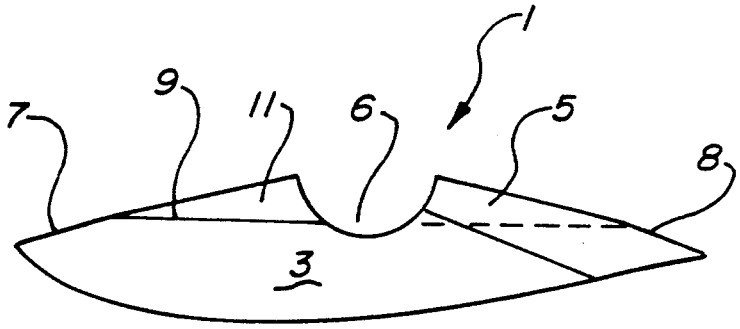

In the drawing, FIG. 1 is a top view of one example of an insert in accordance with this invention. FIG. 2 is a side view and FIG. 3 is an end view. FIG. 4 is an enlarged view showing the top part of the insert.

In one example of an insert in accordance with this invention, insert 1 has two flat parallel sides 2 and 3 which extend in the long dimension of insert 1. Insert 1 has two uppermost slanted surfaces 4 and 5 extending between flat parallel sides 2 and 3. At the top of insert 1 there is a trough 6, substantially orthogonal to flat parallel sides 2 and 3, between uppermost slanted surfaces 4 and 5. Forward edges 7 and 8 of uppermost slanted surfaces 4 and 5 respectively, are the cutting edges of insert 1 and extend upward at an angle of about 20° to the horizontal. Cutting edges 7 and 8 do not extend all the way to trough 6. Instead they terminate at negative edges 9 and 10, respectively. Negative edges 9 and 10 are substantially horizontal and extend to trough 6. Negative edges 9 and 10 are at an angle of about 20° with respect to cutting edges 7 and 8, respectively.

Negative edges 9 and 10 are the forward edges of small surfaces 11 and 12, respectively. Small surfaces 11 and 12 extend upward at an angle from flat sides 2 and 3, respectively, to the top of insert 1.

In one example, insert 1 was made of tungsten carbide containing 5% cobalt and was ¼" thick by 1 1/32" long by about ⅜" high. Trough 6 was 0.125" wide by 0.060" deep and was radiused 0.060" at the bottom thereof. Cutting edges 7 and 8 were about ¼" long. Negative edges 9 and 10 were about 3/16" long.

In operation, inserts in accordance with this invention lasted much longer than prior art inserts not having a trough.

I claim:

1. A mine tool roof bit insert having two flat parallel sides extending in the long dimension of the insert and having two uppermost slanted surfaces extending between said two flat parallel sides, the insert having a trough at the top thereof, the trough and the two uppermost slanted surfaces being substantially parallel and substantially orthogonal along their entire length to the two flat parallel sides, the trough being between the two uppermost slanted surfaces.

2. The mine tool roof bit insert of claim 1 wherein the two uppermost slanted surfaces have forward edges which are the cutting edges of the insert.

3. The mine tool roof bit insert of claim 2 wherein said cutting edges do not extend all the way to the trough but terminate at a negative edge.

4. The mine tool roof bit insert of claim 3 wherein the negative edge is at an angle of about 20° with respect to the cutting edge.

5. The mine tool roof bit insert of claim 1 wherein the bottom of the trough is radiused.

* * * * *